United States Patent [19]

Thompson

[11] 4,180,269

[45] Dec. 25, 1979

[54] WEIGHT ADJUSTMENT OF GOLFING IRON HEADS

[76] Inventor: Stanley C. Thompson, 7851 Talbert St., Apt. 1, Playa Del Rey, Calif. 90271

[21] Appl. No.: 903,813

[22] Filed: May 8, 1978

[51] Int. Cl.[2] ..... A63B 53/04

[52] U.S. Cl. ..... 273/171

[58] Field of Search ..... 273/77 R, 167–174

[56] References Cited

U.S. PATENT DOCUMENTS

| | | | |
|---|---|---|---|
| 2,941,806 | 6/1960 | Stevens | 273/171 X |
| 3,172,668 | 3/1965 | Blake | 273/171 X |
| 3,191,936 | 6/1965 | Guier | 273/171 X |
| 3,212,783 | 10/1965 | Bradley et al. | 273/171 |
| 3,606,327 | 9/1971 | Gorman | 273/171 X |
| 3,625,518 | 12/1971 | Solheim | 273/167 A X |
| 3,761,095 | 9/1973 | Thompson | 273/167 A X |
| 3,897,066 | 7/1975 | Belmont | 273/171 |
| 3,961,796 | 6/1976 | Thompson | 273/171 X |
| 4,145,052 | 3/1979 | Janssen | 273/171 |

FOREIGN PATENT DOCUMENTS

| | | | |
|---|---|---|---|
| 346671 | 4/1931 | United Kingdom | 273/171 |

*Primary Examiner*—Richard J. Apley

*Attorney, Agent, or Firm*—William W. Haefliger

[57] ABSTRACT

An opening is formed in a golf iron head, the opening having an inner wall; a tubular plug is affixed in the opening; the head is exteriorly finished; comminuted weighting material is inserted through the tubular plug into a local interior region of the opening between the wall and plug; and the plug is then closed.

3 Claims, 7 Drawing Figures

WEIGHT ADJUSTMENT OF GOLFING IRON HEADS

BACKGROUND OF THE INVENTION

This invention relates generally to golf clubs, and more particularly concerns improvements in irons for use in the rough where grassy conditions normally interfere with desired engagement of the ball with the iron.

It is known that the ball striking face of an iron should engage the ball in such manner that controlled backspin is imparted to the golf ball. This function is impaired when the ball lies in the rough, for the grass will tend to come between the ball and the grooved striking face of the iron head in such manner that it will interfere with frictional contact and will prevent development of proper ball backspin. No way was known, prior to the present invention, to solve this problem in the manner affording unusual and special advantages in construction, mode of operation and results as described herein. Such advantages exceed those described in my prior U.S. Pat. No. 3,961,796, as will appear. In this regard, prior constructions required the use of a ceramic core to form an opening in the head to receive weighting powder. Leaching of the core to remove it frequently resulted in fracture development in the head itself. Other weight adjustment methods as by adding steel wool, lead or set screws in the shank of the club led to problems with changing the center of gravity of the club.

SUMMARY OF THE INVENTION

The invention is embodied in the head of a golfing iron which is very simply and advantageously weighted, and particularly in relation to a keel at the bottom of the head of the iron. Basically, the iron comprises:

(a) a metallic head having a toe and heel, a front face to strike a golf ball, a rear side, the head having an elongated base portion extending between the toe and heel, (b) an opening formed in the base portion and elongated intermediate the toe and the heel, the opening having an inner end wall and a bore wall, (c) a plug received in said opening with gripping engagement with head metal about the opening to retain the plug in position, there being a space between the plug and said inner end wall, the plug containing a through port to pass head weighting material from the exterior through the plug and into said space, said material being comminuted, (d) said opening adapted to receive means to close said port.

As will be seen, the plug typically extends to a contoured outer surface defined by the toe, to approximately fill that opening up to the toe contour; the means to close the plug may comprise a threaded insert which is received into a threaded bore defined by the plug after the weight material is introduced through that port; the insert also extends to approximately the outer end of the plug, and is jammed in position closing the port through the plug; and the weighting material is confined directly above a keel defined by the iron, for optimum balancing of the club in relation to the keel. In this regard, greater or lesser amounts of the weighting material (as for example Tungsten) may be introduced into the space above the keel, in respect of different clubs in order to achieve relative balance or matching of a set of clubs, without affecting the balance relationship of the keel to the material, since the two are typically in vertically spaced relation.

These and other objects and advantages of the invention, as well as the details of illustrative embodiment, will be more fully understood from the following description and drawings, in which:

DRAWING DESCRIPTION

Figure 1:
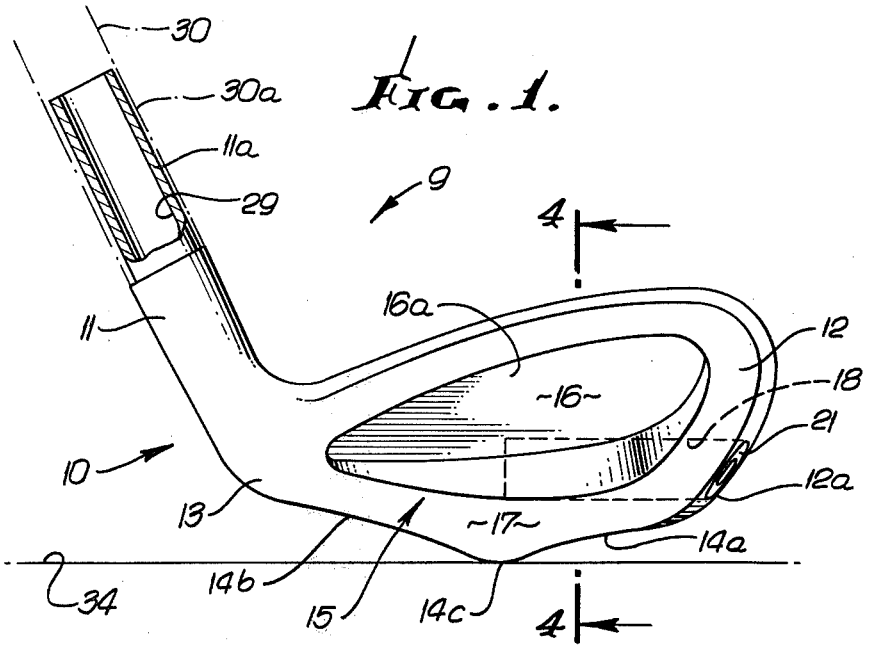
FIG. 1 is a rear side elevation of the head of a golfing iron embodying the invention.
Figure 2:
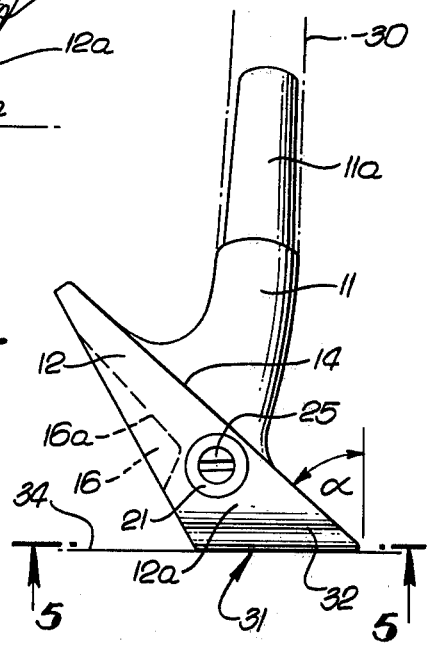
FIG. 2 is a toe end elevation of the FIG. 1 head.
Figure 3:
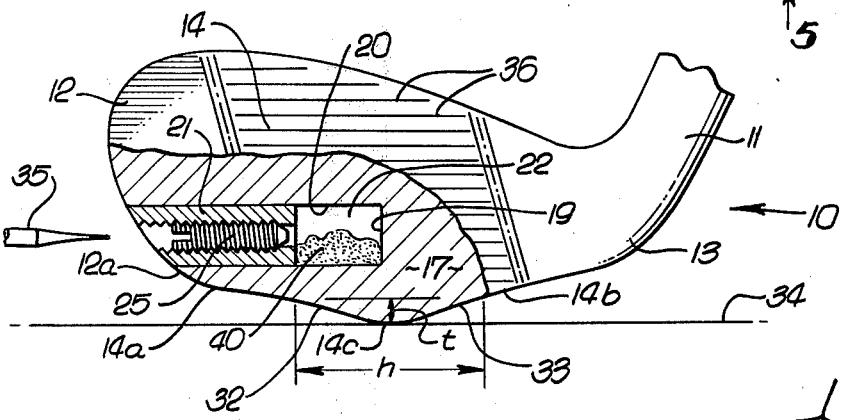
FIG. 3 is a front side elevation of the FIG. 1 head, the lower portion of which is cut away to show interior structure.
Figure 3A:
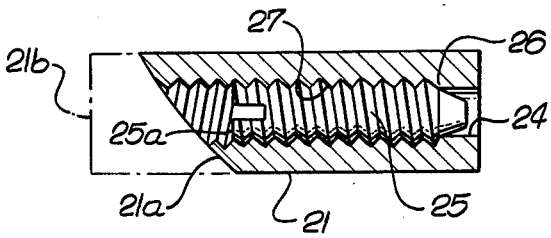
Figure 4:
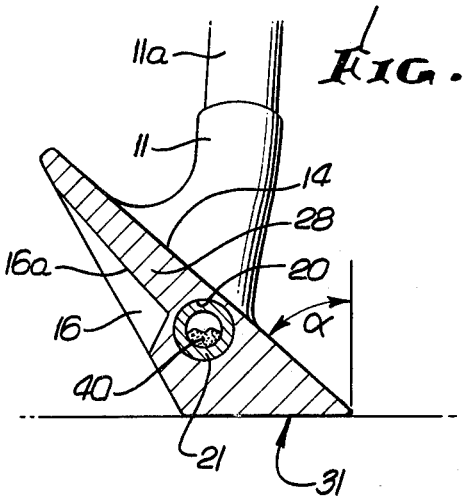
Figure 5:
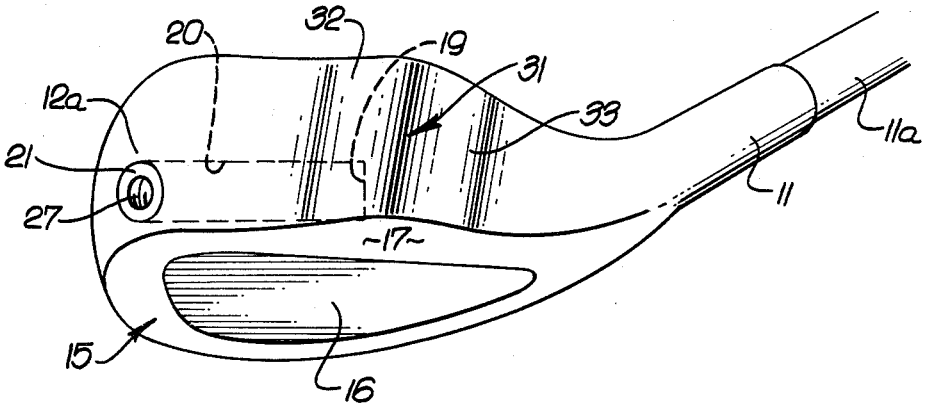

FIG. 3*a* is an enlarged section showing plug reception of a threaded insert;

FIG. 4 is a section taken on lines 4—4 of FIG. 1;

FIG. 5 is a view taken on lines 5—5 of FIG. 2; and

Figure 6:
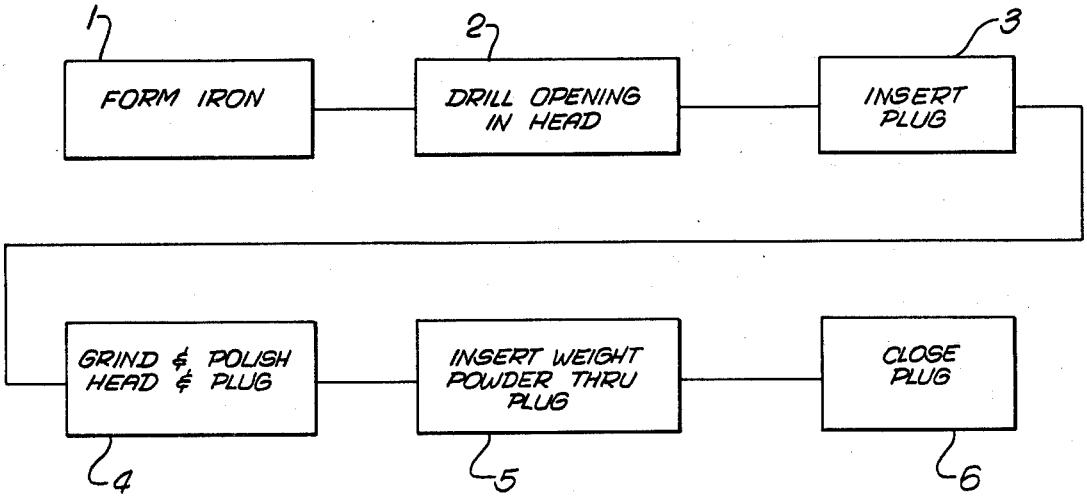

FIG. 6 is a block diagram showing steps in adjusting the weight of the iron.

DETAILED DESCRIPTION

Referring first to FIGS. 1–5 the metallic head 10 of an upright golf club iron 9 includes a hosel 11, toe 12 and heel 13, a front face 14 to strike a golf ball, a rear side 15 recessed at 16, and a base portion 17. Front face 14 has an inclination $\alpha$ from a vertical plane which may vary as required for the intended use of the iron; in this regard, the illustrated iron is intended to represent an iron known as a wedge for which $\alpha$ is between about 50 degrees from vertical, in FIG. 4.

An opening 18 is formed in the base portion 17, the opening being elongated intermediate the toe and heel. The opening is preferably drilled or otherwise formed to extend from the lower arcuate extent 12*a* of the toe, and toward the heel, the opening having an inner end wall 19 and a bore wall 20. Note that the opening is located generally near lower wall 16*a* of recess 16, in FIG. 4.

A plug 21 is received in the opening 18 with gripping engagement with the head metal about the opening, to retain the plug in position. Typically, the plug may consist of metal, as for example brass, and it has interference engagement with the bore 20. For example, the plug may be forced into the opening, or it may be cooled well below the temperature of the head, and then inserted into the opening and allowed to come up to head temperature, expanding to grip the bore. The plug is typically less than one inch long, whereas the length of the opening 18 is typically over one inch, as for example $1\frac{5}{8}$ inch. The temperature coefficient of the plug and head metal (such as steel) are typically about the same.

In plug inserted position, a space 22 remains between the plug and the end wall 19 to receive head weighting material 40 which is comminuted. One example is heavy metal powder such as Tungsten, of greater density than steel. A precise amount of such powder, as determined by balancing the club after completion of fabrication, is inserted into space 22 via a through port 24 in the plug. For that purpose, the plug itself may be tubular. Also, the port bore is threaded along only part of its length to receive an exteriorly threaded insert such as set screw 25. The forward end of the latter jams against the plug shoulder 26 at the transition between bore 24 and thread 27, as best seen in FIG. 3*a*, whereby the insert is tightly retained in position. A tool to rotate the end slotted insert is shown at 35. The insert material may consist of brass to facilitate is removal from the plug, if desired to replace material 40. Accordingly, the need for drilling a long through bore through the head is avoided; any need for a ceramic core is eliminated; only a relatively short length opening 20 is required and may be conveniently drilled; and the retention means for the heavy weighting powder is extremely simple and easy to fabricate and insert. Note that the outer end 21*a* of the plug 21 is rounded to match the surface contour of the club toe 12. Originally, the plug end may protrude as indicated by broken lines 21*b*; however, it is subsequently ground down to match the toe contour. The insert outer end 25*a* extends to approximately the contoured end of the plug. Further, the structure is such as to serve to lighten the weight of the club head as well as to enable accurate and rapid balancing as required to "match" a set of irons. Note that the recess 16, which contributes to the light weight characteristics of the head, is directly above the base portion 17 that contains the plug 21. The inner wall 16*a* of the recess and the front face 14 define therebetween a relatively thin plate 28 which receives the direct impact developed when the head strikes the golf ball.

Hosel 11 includes an elongated stem 11*a* which contains an elongated bore 29, the latter also contributing to reduction of head weight. The stem is attached to the club shaft 30 as by a telescopic interfit of the shaft end over the stem, at 30*a* in FIG. 1.

The front face 14 has lower edge portions 14*a* and 14*b* which taper downwardly and toward one another from the toe and heel, respectively, thereby to define an apex portion 14*c*. The latter is generally below the center of the ball striking zone (as delineated by the horizontal grooves 36 in the front face), the apex portion being downwardly convexly rounded.

The head underside between the toe and heel also defines a keel 31 extending from the apex portion as a rearwardly elongated extension thereof, the keel being downwardly rounded or convex. Further, the underside of the base 17 has faces 32 and 33 at opposite sides of the keel and which have downward concavity. Note that the extent "h" of the keel, of height "t" is below balancing or weighting material 40, in FIG. 3, in a direction looking rearwardly toward the front face of the club, with the keel resting flatly on horizontal surface 34.

In addition, the faces 32 and 33 extend forwardly toward the front face and merge at rounded edges with the downwardly tapering edge lower portions of the front face. As a result, the grass is parted by the keel away from the front face grooving 30, the balance weighting of the club is generally centered with respect to the keel, and located closely above the keel, and the balancing (absence of head steel in opening 20 plus presence of plug 21, insert 25 and powder 40) compensates for the additional weight of the steel keel, so that the club does not "feel" or swing differently, in the estimation of the golfer, from a club lacking such a steel keel.

The method of adjusting the weight of the club head is designated in FIG. 6. As there shown, the rough iron is formed, as indicated by step #1 after which opening 20 is formed in the steel head, as indicated by step #2. Step #3 involves forcible insertion of the plug 21 into the opening 20 leaving a portion of the plug protruding from the toe, as indicated at 21*b* in FIG. 3*a*. The head 10 is then ground, removing excess plug material (to contour line 21*a* in FIG. 3*a*), and then polished, as seen in step #4. Step #5 involves insertion of weighting powder through the plug and into space 22; and finally, the plug is closed by insertion of insert 25, as indicated by step #6.

I claim:

1. In a golf iron, (a) a metallic head having a toe and heel, a front face to strike a golf ball, a rear side, the head having an elongated base portion extending between the toe and heel, (b) an opening formed in the base portion and elongated intermediate the toe and the heel, the opening having an inner end wall and a bore wall, (c) a tubular plug received in said opening with gripping engagement with head metal about the opening to retain the plug in position, there being a space between the plug and said inner end wall, the plug containing a through port to pass head weighting material from the exterior through the plug and into said space after the plug is in place, said material being comminuted, (d) and insert means threadably received in said port to close said port, the insert means having an innermost end, (e) said space generally centrally located between the toe and heel, (f) the plug defining an interior annular shoulder against which an end portion of the insert means is jammed to locate said innermost end proximate the inner end of the plug.

2. The golf iron of claim 1 including said weighting powder in said space, said powder having a density greater than that of said head metal.

3. The golf iron of claim 1 wherein said head includes a rearwardly extending, downwardly projecting keel at the bottom of said base portion, said keel located about mid-way between said toe and heel, and said opening extends from said toe toward the heel but terminates at said end wall which is above the keel.

* * * * *